US009647384B2

(12) United States Patent
Rajpal et al.

(10) Patent No.: US 9,647,384 B2
(45) Date of Patent: May 9, 2017

(54) BACK BODY FOR COAXIAL CONNECTOR

(71) Applicant: CommScope Technologies LLC, Hickory, NC (US)

(72) Inventors: Taig S. Rajpal, Chicago, IL (US); Frank A. Harwath, Naperville, IL (US); Ronald A. Vaccaro, Shorewood, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/017,019

(22) Filed: Feb. 5, 2016

(65) Prior Publication Data

US 2016/0233610 A1 Aug. 11, 2016

Related U.S. Application Data

(60) Provisional application No. 62/113,854, filed on Feb. 9, 2015.

(51) Int. Cl.
*H01R 9/05* (2006.01)
*H01R 13/58* (2006.01)

(52) U.S. Cl.
CPC ..... *H01R 13/5812* (2013.01); *H01R 13/5808* (2013.01)

(58) Field of Classification Search
CPC ..... H01R 2103/00; H01R 9/0521
USPC ..... 439/578, 583–585
See application file for complete search history.

(56) References Cited

U.S. PATENT DOCUMENTS 6,607,398 B2 * 8/2003 Henningsen ..... H01R 24/564 439/578
6,786,767 B1 9/2004 Fuks et al.
7,189,113 B2 * 3/2007 Sattele ..... H01R 13/6277 439/253
7,288,002 B2 * 10/2007 Rodrigues ..... H01R 13/5816 439/439
7,637,774 B1 * 12/2009 Vaccaro ..... H01R 9/0521 29/828
7,798,847 B2 * 9/2010 Islam ..... H01R 13/52 439/278
7,841,896 B2 * 11/2010 Shaw ..... H01R 9/0521 439/578
7,845,978 B1 * 12/2010 Chen ..... H01R 9/0521 439/578

(Continued)

OTHER PUBLICATIONS

International Search Report and Written Opinion for corresponding PCT Application No. PCT/US2016/016727, date of mailing May 23, 2016, 12 pages.

*Primary Examiner* — Thanh Tam Le
(74) *Attorney, Agent, or Firm* — Myers Bigel, P.A.

(57) ABSTRACT

A back body for a cable-connector assembly includes: an annular central portion; an annular mating portion that merges with one end of the central portion and is configured to mate with an outer conductor extension of a coaxial connector; and a plurality of fingers that extend axially from an opposite end of the central portion, the fingers being configured to flex inwardly to engage a jacket of a coaxial cable. The central portion, the mating portion, and the fingers define a bore configured to receive the coaxial cable. A radial clamp is configured to apply radially-inwardly directed pressure to the fingers.

20 Claims, 3 Drawing Sheets

(56) References Cited

U.S. PATENT DOCUMENTS

| | | | | |
|---|---|---|---|---|
| 7,927,135 | B1 * | 4/2011 | Wlos | H01R 9/0521 439/584 |
| 7,934,954 | B1 * | 5/2011 | Chawgo | H01R 9/0524 439/578 |
| 8,367,944 | B2 * | 2/2013 | Chiou | H02G 3/0691 174/480 |
| 8,591,255 | B2 * | 11/2013 | Holliday | H01R 24/40 439/277 |
| 8,944,846 | B2 * | 2/2015 | Lee | H01R 9/0524 439/584 |
| 9,190,762 | B2 * | 11/2015 | Xu | H01R 13/502 |
| 2010/0130060 | A1 | 5/2010 | Islam | |
| 2012/0171894 | A1 | 7/2012 | Malloy et al. | |
| 2013/0178097 | A1 | 7/2013 | Wild et al. | |
| 2014/0045357 | A1 | 2/2014 | Nugent | |

* cited by examiner

BACK BODY FOR COAXIAL CONNECTOR

RELATED APPLICATION

The present application claims the benefit of and priority from U.S. Provisional Patent Application No. 62/113,854, filed Feb. 9, 2015, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between a cable terminated with a connector bearing the desired connector interface and a corresponding connector with a mating connector interface mounted on an apparatus or on another cable. Typically, one connector will include a structure such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

SUMMARY

As a first aspect, embodiments of the invention are directed to a back body for a cable-connector assembly, comprising: an annular central portion; an annular mating portion that merges with one end of the central portion and is configured to mate with an outer conductor extension of a coaxial connector; and a plurality of fingers that extend axially from an opposite end of the central portion, the fingers being configured to flex inwardly to engage a jacket of a coaxial cable. The central portion, the mating portion, and the fingers define a bore configured to receive the coaxial cable. A radial clamp is configured to apply radially-inwardly directed pressure to the fingers.

As a second aspect, embodiments of the invention are directed to a coaxial cable-connector assembly a coaxial cable, a coaxial connector, and a back body. The coaxial cable comprises: an inner conductor having a termination end; a first dielectric layer that overlies the inner conductor; an outer conductor that overlies the first dielectric layer having a termination end; and a jacket that overlies the outer conductor having a termination end. The coaxial connector comprises an inner contact electrically connected with the termination end of the inner conductor of the coaxial cable and an outer conductor extension electrically connected with the termination end of outer conductor of the coaxial cable.

The back body comprises: an annular central portion; an annular mating portion that merges with one end of the central portion and mates with the outer conductor extension; and a plurality of fingers that extend axially from an opposite end of the central portion. The central portion, the mating portion, and the fingers define a bore that receives the coaxial cable. A radial clamp applies radially-inwardly directed pressure to the fingers to flex the fingers radially inwardly to engage the jacket of the coaxial cable.

As a third aspect, embodiments of the invention are directed to a coaxial connector assembly, comprising: an inner contact configured to be electrically connected with the termination end of an inner conductor of a coaxial cable; an outer conductor extension electrically connected with a termination end of an outer conductor of the coaxial cable; and a back body. The back body comprises: an annular central portion; an annular mating portion that merges with one end of the central portion and mates with the outer conductor extension; a plurality of fingers that extend axially from an opposite end of the central portion, wherein the central portion, the mating portion, and the fingers define a bore that is configured to receive the coaxial cable; and a radial clamp that applies radially-inwardly directed pressure to the fingers to flex the fingers radially inwardly to engage the jacket of the coaxial cable.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms “a”, "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
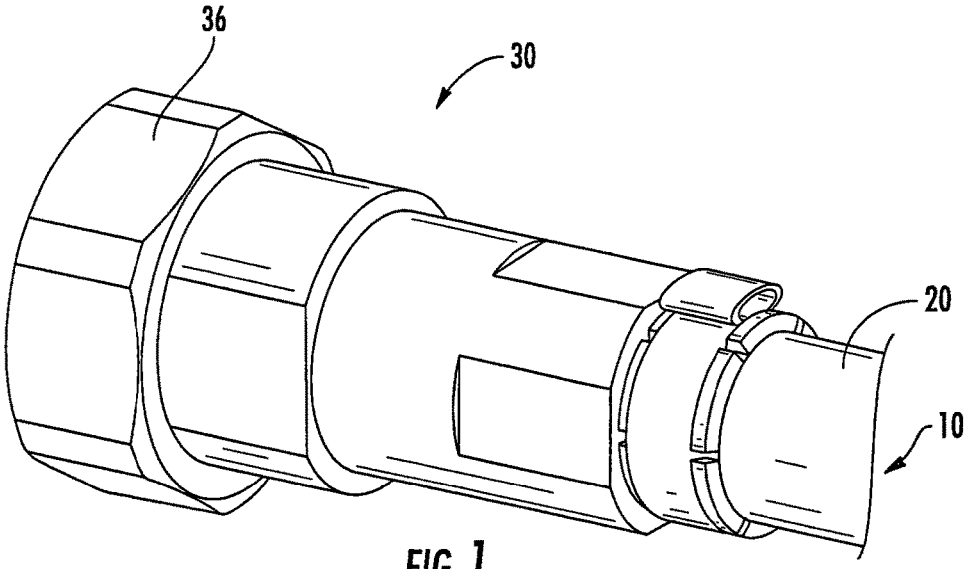
FIG. 1 is a perspective view of a coaxial cable-connector assembly according to embodiments of the invention.

FIG. 1 illustrates a coaxial cable, designated broadly at 10, and a coaxial plug, designated broadly at 30, according to embodiments of the present invention. The cable 10 (also seen in FIG. 4) may be of conventional construction and include a central conductor 12, a dielectric layer 14 that circumferentially overlies the central conductor 12, an outer conductor 16 that circumferentially overlies the dielectric layer, and a polymeric cable jacket 20 that circumferentially overlies the outer conductor 16. These components will be well-known to those of skill in this art and need not be described in detail herein.

Referring again to FIGS. 2-4, the plug 30 enables the cable 10 to be connected with a jack of a mating coaxial cable or piece of equipment. The plug 30 includes a central contact 32, an outer body 34, a coupling nut 36, an O-ring 38, and a back body (or overmold body) 40. The central conductor extension 32 and the outer conductor extension 34 are configured to mate at their free ends (i.e., the ends on the left side of FIG. 2) with the respective conductors of a mating coaxial cable jack (not shown). One exemplary configuration for the central and outer conductor extensions 32, 34 is a 7/16 DIN connection, although other configurations, such as Type N and 4.1/9.5 DIN, may also be employed.

Figure 2:
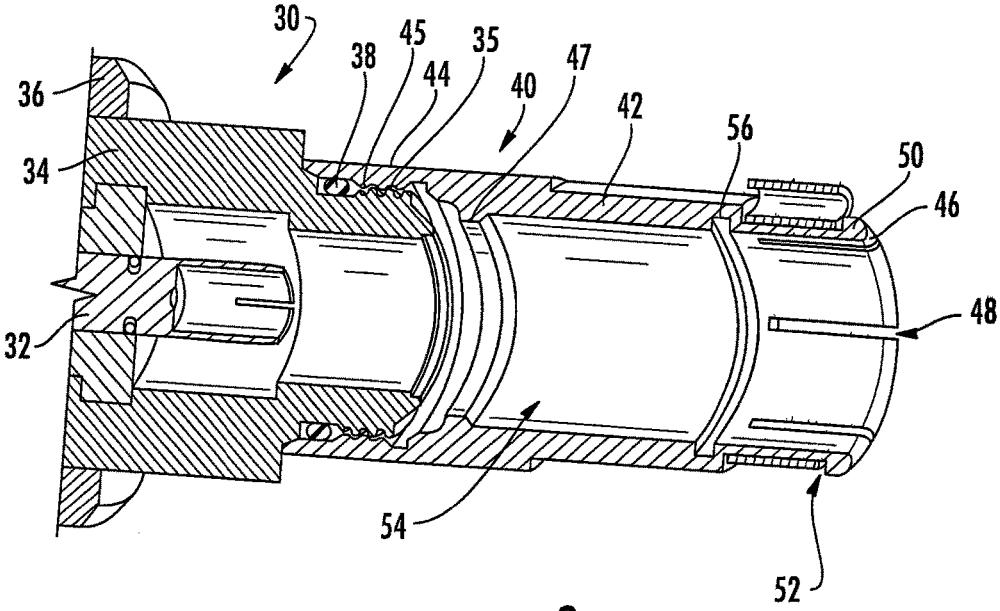
FIG. 2 is a partial cross-section of the coaxial cable-connector assembly of FIG. 1 with the cable and O-ring removed.
Figure 3:
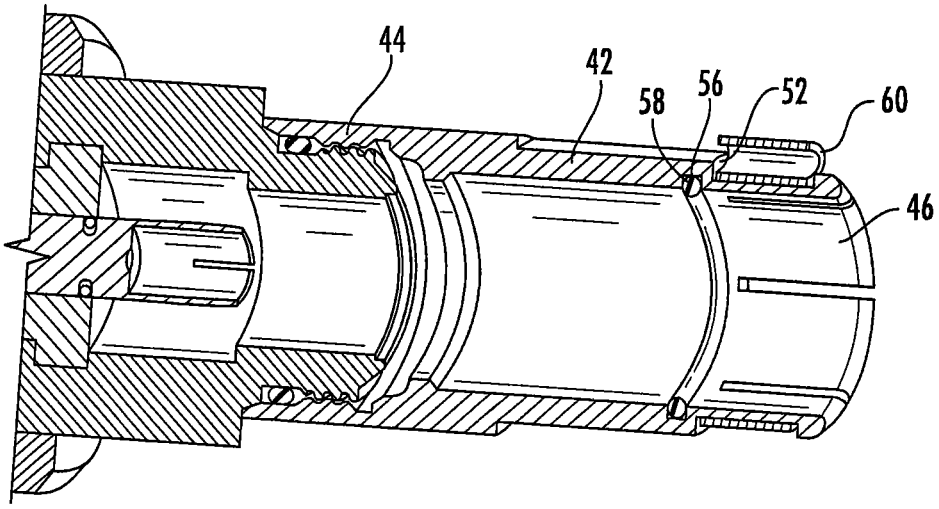
FIG. 3 is a partial cross-section of the coaxial cable-connector assembly of FIG. 1 with the cable removed.

Referring now to FIG. 2, the back body 40 is generally annular and includes a central portion 42, a slightly enlarged mating portion 44 at one end, and fingers 46 extending axially from the opposite end separated from each other by slots 48. As can be seen in FIG. 2, the mating portion 44 is configured to fit over a portion of the outer conductor extension 34 and to attach to the outer conductor extension 34 with threads 45 that engage threads 35 on the outer surface of the outer conductor extension 34. An inwardly-projecting annular ridge 47 divides the central portion 42 and the mating portion 44. Each of the fingers 46 includes a radially outward-extending hook 50. The hooks 50 and the edge of the central portion 42 define a recess 52. The inner surfaces of the fingers 46 and the central portion 42 define a bore 54 that is configured to receive the cable 10. A groove 56 is present in the central portion 42 near the base of the fingers 46. An O-ring 58 resides within the groove 56 (see FIG. 3).

Figure 4:
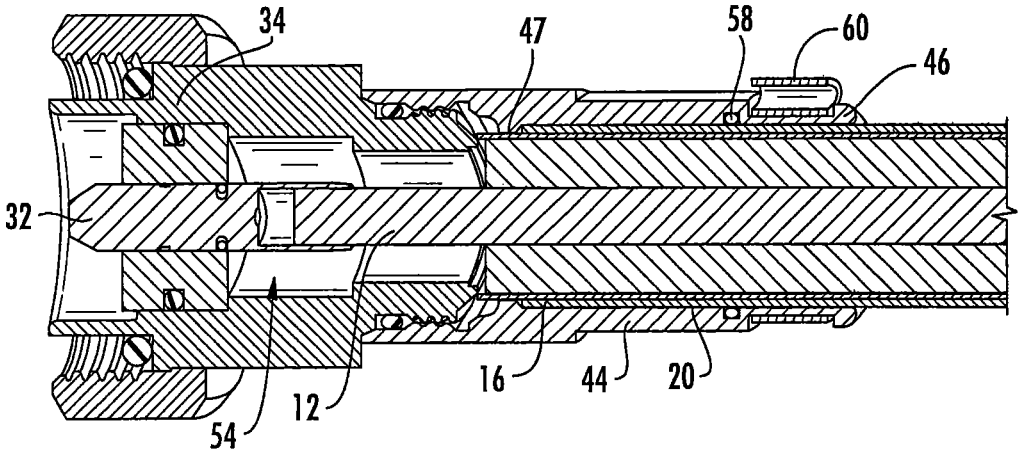
FIG. 4 is a partial cross-section of the coaxial cable-connector assembly of FIG. 1 with the cable present.

As seen in FIG. 4, the end of the cable 10 extends through the bore 54. The center conductor 12 mates with the central contact 32, and the outer conductor 16 engages the outer conductor extension 34. The ridge 47 helps to align the cable 10 within the bore 54 via engagement with the outer conductor 16. The jacket 20 fits within the central portion 42 and the fingers 46. It can be seen that the O-ring 58 engages the jacket 20, thereby providing an environmental seal between the jacket 20 and the back body 40.

As can be seen in FIG. 4, the back body 40 can be attached to the cable 10 via a radial clamp 60 that fits within the recesses 52 in the fingers 46. The radial clamp 60 may be, for example, an oetoker clamp, a "zip-tie", a spring clamp, or the like that applies radially inward pressure when in operation. The radial clamp 60 applies pressure to the fingers 46, causing them to deflect radially inwardly to grip the jacket 20 of the cable 10. In some embodiments, the fingers 46 may have knurls or other textured features on their inner surfaces to assist in engaging the jacket 20.

The back body 40 may be formed of any material that is sufficiently flexible (conductive or non-conductive) to deflect under the pressure of the radial clamp 60. Exemplary materials include plated brass.

Figure 5:
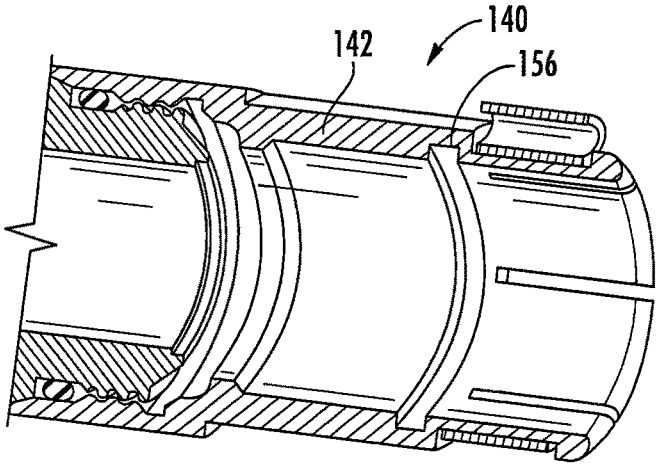
FIG. 5 is a partial cross-section of the coaxial cable-connector assembly of similar to that of FIG. 1 with an alternative back body and with the cable and O-ring removed.
Figure 6:
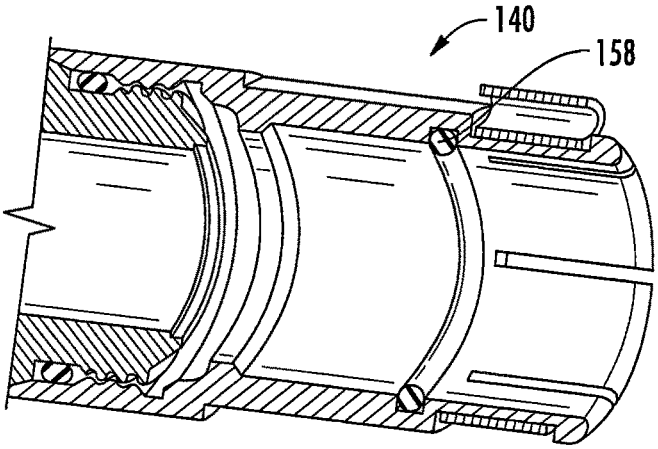
FIG. 6 is a partial cross-section of the coaxial cable-connector assembly of FIG. 5 with the cable removed.
Figure 7:
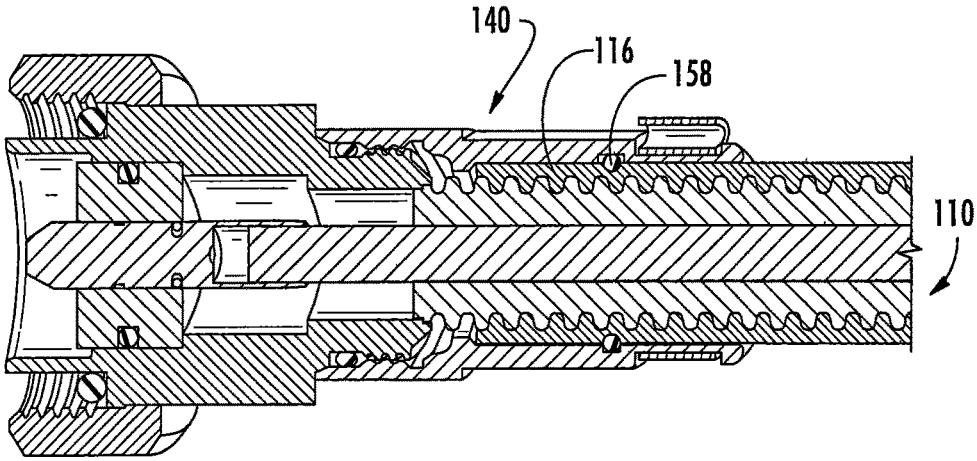
FIG. 7 is a partial cross-section of the coaxial cable-connector assembly of FIG. 5 with the cable present.

Another embodiment of a back body, designated broadly at 140, is shown in FIGS. 5-7. The back body 140 is similar to the back body 40 with the exception that a larger groove 156 is present in the central portion 142 to receive a larger O-ring 158. The larger O-ring 158 is configured to engage the outer conductor 116 of the cable 110 within a corrugation thereof; thus, it can be seen in FIG. 7 that the jacket 120 of the cable is stripped farther from the end of the cable to enable the O-ring 158 to engage the exposed outer conductor 116.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A back body for a cable-connector assembly, comprising:

an annular central portion;

an annular mating portion that merges with one end of the central portion and is configured to mate with an outer conductor extension of a coaxial connector; and a plurality of fingers that extend axially from an opposite end of the central portion, the fingers being configured to flex inwardly to engage a jacket of a coaxial cable;

wherein the central portion, the mating portion, and the fingers define a bore configured to receive the coaxial cable; and a radial clamp configured to apply radially-inwardly directed pressure to the fingers without axial movement relative to the fingers.

2. The back body defined in claim 1, wherein the radial clamp comprises an oetoker clamp.

3. The back body defined in claim 1, wherein the radial clamp comprises a zip tie.

4. The back body defined in claim 1, wherein the fingers include recesses in radially outward surfaces thereof that receive the radial clamp.

5. The back body defined in claim 1, wherein the central portion includes a circumferential groove in an inner surface thereof, and further comprising an O-ring in the groove.

6. The back body defined in claim 1, wherein the fingers are arcuate in cross-section and are separated from each other by slots.

7. The back body defined in claim 1 in combination with a coaxial connector.

8. A coaxial cable-connector assembly, comprising:

(a) a coaxial cable comprising:

an inner conductor having a termination end;

a first dielectric layer that overlies the inner conductor;

an outer conductor that overlies the first dielectric layer having a termination end; and a jacket that overlies the outer conductor having a termination end;

(b) a coaxial connector comprising an inner contact electrically connected with the termination end of the inner conductor of the coaxial cable and an outer conductor extension electrically connected with the termination end of the outer conductor of the coaxial cable; and (c) a back body comprising:

an annular central portion;

an annular mating portion that merges with one end of the central portion and mates with the outer conductor extension; and a plurality of fingers that extend axially from an opposite end of the central portion;

wherein the central portion, the mating portion, and the fingers define a bore that receives the coaxial cable; and a radial clamp that applies radially-inwardly directed pressure to the fingers to flex the fingers radially inwardly to engage the jacket of the coaxial cable without axial movement relative to the fingers.

9. The coaxial cable-connector assembly defined in claim 8, wherein the radial clamp comprises an oetoker clamp.

10. The coaxial cable-connector assembly defined in claim 8, wherein the radial clamp comprises a zip tie.

11. The coaxial cable-connector assembly defined in claim 8, wherein the fingers include recesses in radially outward surfaces thereof that receive the radial clamp.

12. The coaxial cable-connector assembly defined in claim 8, wherein the central portion includes a circumferential groove in an inner surface thereof, and further comprising an O-ring in the groove.

13. The coaxial cable-connector assembly defined in claim 12, wherein the O-ring engages the jacket of the coaxial cable.

14. The coaxial cable-connector assembly defined in claim 12, wherein the O-ring engages the outer conductor of the coaxial cable.

15. The coaxial cable-connector assembly defined in claim 14, wherein the outer conductor comprises a plurality of corrugations, and wherein the O-ring engages the outer conductor in one of the plurality of corrugations.

16. The coaxial cable-connector assembly defined in claim 8, wherein the fingers are arcuate in cross-section and are separated from each other by slots.

17. A coaxial connector assembly, comprising:

an inner contact configured to be electrically connected with a termination end of an inner conductor of a coaxial cable;

an outer conductor extension electrically connected with a termination end of an outer conductor of the coaxial cable; and a back body comprising:

an annular central portion;

an annular mating portion that merges with one end of the central portion and mates with the outer conductor extension;

a plurality of fingers that extend axially from an opposite end of the central portion;

wherein the central portion, the mating portion, and the fingers define a bore that is configured to receive the coaxial cable; and a radial clamp that applies radially-inwardly directed pressure to the fingers to flex the fingers radially inwardly to engage the jacket of the coaxial cable without axial movement relative to the fingers.

18. The assembly defined in claim 17, wherein the radial clamp comprises an oetoker clamp or a zip tie.

19. The assembly defined in claim 17, wherein the fingers include recesses in radially outward surfaces thereof that receive the radial clamp.

20. The assembly defined in claim 17, wherein the central portion includes a circumferential groove in an inner surface thereof, and further comprising an O-ring in the groove.

* * * * *